US005848643A

United States Patent [19]

Carbaugh et al.

[11] Patent Number: 5,848,643

[45] Date of Patent: Dec. 15, 1998

[54] ROTATING BLOWOUT PREVENTER

[75] Inventors: William L. Carbaugh, Humble; Sylvester A. Joan, Houston, both of Tex.

[73] Assignee: Hydril Company, Houston, Tex.

[21] Appl. No.: 770,719

[22] Filed: Dec. 19, 1996

[51] Int. Cl.[6] ..... E21B 33/06

[52] U.S. Cl. ..... 166/85.4; 166/84.3; 166/84.4

[58] Field of Search ..... 166/85.4, 85.1, 166/84.3, 84.4

[56] References Cited

U.S. PATENT DOCUMENTS

| | | | |
|---|---|---|---|
| 3,621,912 | 11/1971 | Wooddy, Jr. et al. | 166/0.5 |
| 3,934,887 | 1/1976 | Biffle | 277/31 |
| 3,965,987 | 6/1976 | Biffle | 166/315 |
| 4,500,094 | 2/1985 | Biffle | 277/31 |
| 4,531,580 | 7/1985 | Jones | 166/84.3 |
| 4,754,820 | 7/1988 | Watts et al. | 175/195 |
| 4,828,024 | 5/1989 | Roche | 166/84.4 |
| 5,178,215 | 1/1993 | Yenulis et al. | 166/80 |
| 5,224,557 | 7/1993 | Yenulis et al. | 175/195 |
| 5,277,249 | 1/1994 | Yenulis et al. | 166/84 |
| 5,279,365 | 1/1994 | Yenulis et al. | 166/84 |

OTHER PUBLICATIONS

Article "RBOP™ Oil Tools International, Inc. 1500 psi Rotating Blowout Preventer" 2 pgs., from Big D Rental & Sales (1981) Ltd.

Article "NL Shaffer Pressure Control", p. 4732 from NL Industries, Inc. (undated).

*Primary Examiner*—Roger Schoeppel

*Attorney, Agent, or Firm*—Rosenthal & Osha LLP

[57] ABSTRACT

A rotating blowout preventer is disclosed that provides the rotating spindle assembly with lugs that are moved downwardly through vertical slots in the preventer housing then horizontally into horizontal grooves in the housing to lock the rotating spindle assembly to the housing and that move horizontally out of the horizontal grooves and upwardly through vertical slots to release the rotary spindle assembly from the housing for making a connection or a trip.

8 Claims, 2 Drawing Sheets

ROTATING BLOWOUT PREVENTER

This invention relates to rotating blowout preventers, sometimes called rotating drilling heads or rotating kelly packers generally, and in particular to apparatus for and a method of connecting and disconnecting the rotating assembly of a rotating blowout preventer to and from the non-rotating body that is attached to the blowout preventer stack.

Rotating blowout preventers seal tightly around kellys, drill pipe, drill collars, tubing or casing and are used for drilling in areas susceptible to kicks or blowouts, for drilling under pressure, for drilling with reverse circulation and when circulating with natural gas or air. They can be used for drilling with pressure in the well. They will also allow pipe to be stripped in and out of the hole with pressure in the well. These situations where operations are being conducted under pressure are referred to as "under balance" drilling as opposed to balanced drilling where the mud system is balanced and there is no need for seals between the drill pipe, kelly, etc., to prevent fluid from the well bore from flowing upwardly past the mud return line.

Rotating blowout preventers generally include a stationary body that is mounted on top of the blowout preventer stack and a removable rotating spindle assembly that is latched into the body and has a rotating portion that rotates with the kelly during drilling operation. The rotating spindle assembly includes a stripper rubber that provides a seal between the rotating spindle assembly and the kelly or drill pipe. Whenever it is necessary to remove the entire rotating spindle assembly, it can be released from the housing and moved upwardly with the kelly to allow a joint of pipe to be added to the drill string or replacement of the rotating spindle asembly by either another rotating spindle assembly or a flanged riser. In rotating blowout preventers presently used, the rotating assembly is bolted or clamped to the housing, which makes the releasing and reconnecting the rotating spindle assembly to the housing time-consuming and complicated.

It is an object of this invention to provide improved means for releasing the rotating spindle assembly of a rotating blowout preventer from the housing and for reconnecting the rotating spindle assembly to the housing simply by rotating the rotating spindle assembly relative to the housing a short distance in opposite directions.

It is a further object and a feature of this invention to provide such a release mechanism that includes a simple and convenient manner of locking the release mechanism so that the rotating spindle assembly cannot be inadvertently released from the housing.

These and other objects and advantages of this invention will be apparent to those skilled in the art from a consideration of this specification, including the attached drawings and appended claims.

IN THE DRAWINGS

Figure 1:
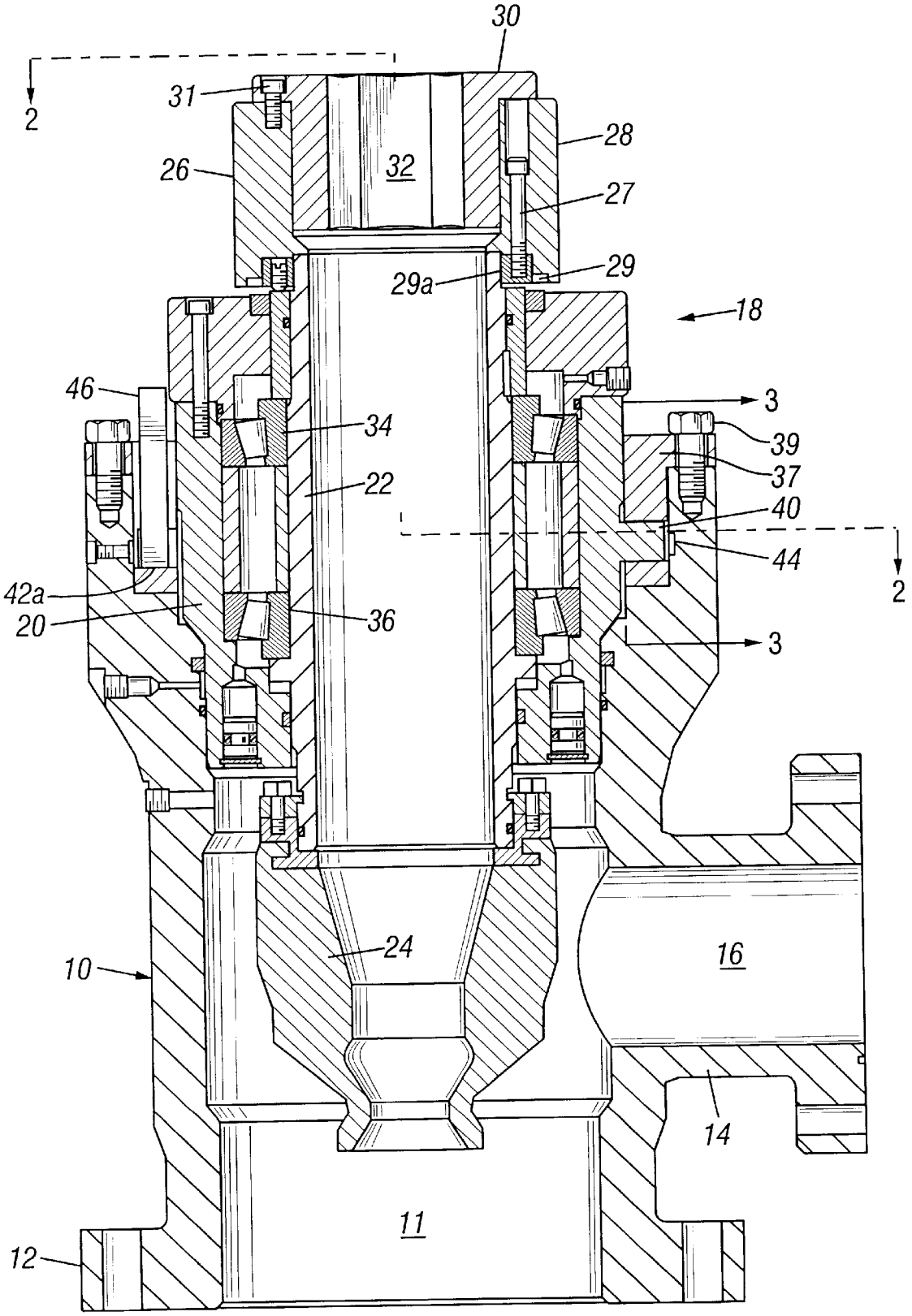
FIG. 1 is a vertical sectional view taken through the rotating blowout preventer or drilling head of this invention with the rotating spindle assembly locked in engagement with the body that is attached to the blowout preventer stack (not shown).

The drilling head of FIG. 1 includes tubular body 10 having a longitudinally extending central opening 11 and lower flange 12 for bolting the body to the top of a blowout preventer stack. Mud return line 14 extends laterally from body 10 to provide passageway 16 through which drilling mud, or whatever fluid is flowing from the well, to flow laterally from opening 11 to the mud pits. Mounted in opening 11 in body 10 is rotating spindle assembly 18. The assembly includes non-rotating spindle assembly housing 20 and rotating sleeve 22 that extends through the rotating spindle assembly housing and is connected at its lower end to stripper rubber 24.

Sleeve 22 is connected at its upper end to upper drive bushing assembly 26. This assembly includes collar 28 that is attached to sleeve 22 by bolt 27 and drive ring 29 that is attached to sleeve 22 by threads 29*a*. Kelly bushing 30 is attached to collar 28 by cap screws 31. The kelly bushing is provided with a hex or a square opening 32 through which the kelly extends. Whether it is a hex or a square opening will depend upon the kelly, of course, but this provides a drive connection between the kelly and the rotating spindle assembly so that the rotating spindle assembly will rotate with the kelly. Upper and lower bearings 34 and 36 support the spindle assembly for rotation relative to stationary body 20 of the spindle assembly.

Figure 2:
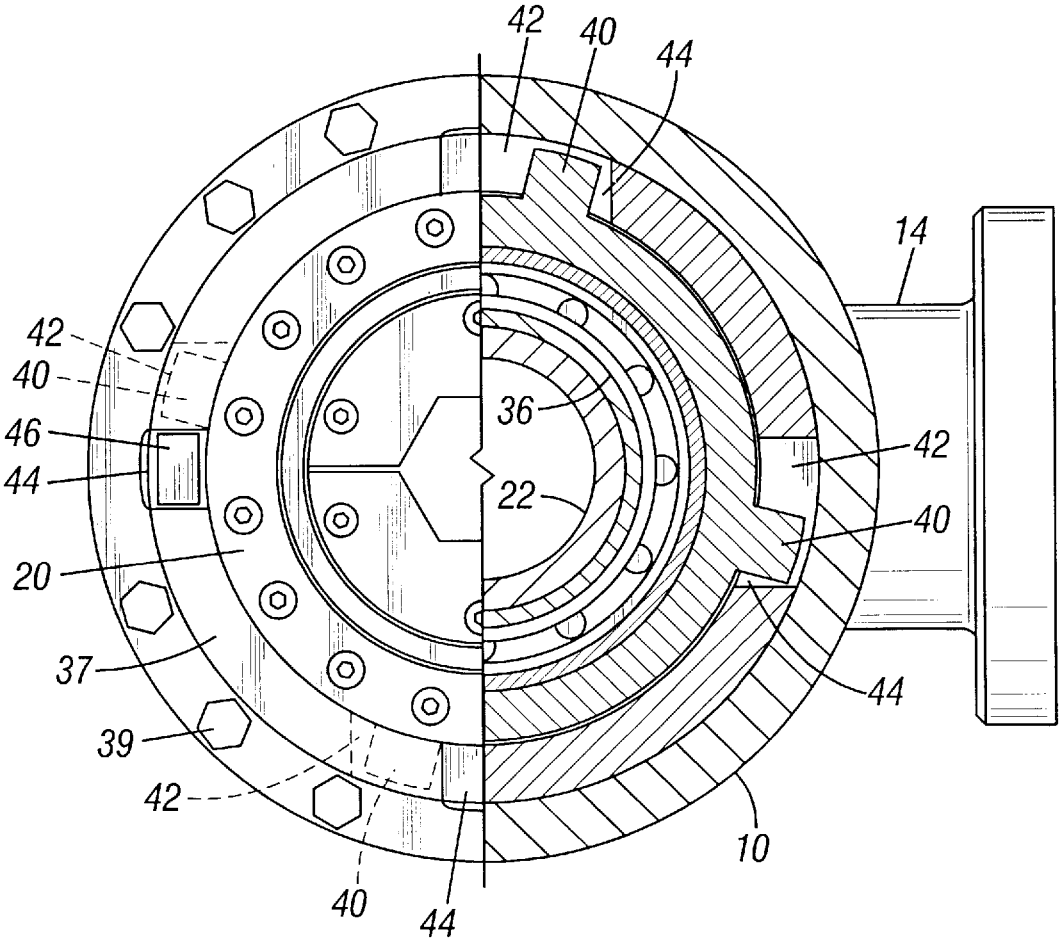
FIG. 2 is a section partly in elevation and partly in section taken along line 2—2 of FIG. 1.
Figure 3:
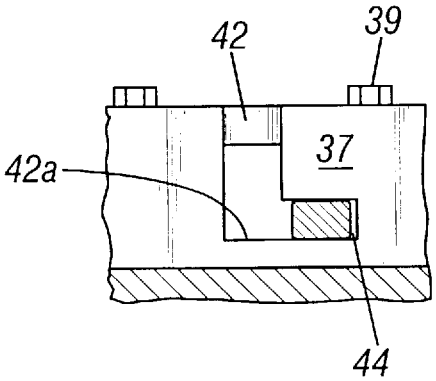
FIG. 3 is a sectional view taken along line 3—3 of FIG. 1.

In accordance with this invention, rotating spindle assembly 18 is held in body 10 of the rotating blowout preventer by lugs 40, four of which are shown in this embodiment. These lugs are integrally attached to the outside of housing 20. The rotating spindle assembly is locked in the housing by lowering the assembly into opening 11 of body 10 with lugs 40 passing through vertical slots 42 in annular housing ring 37 mounted on the top of body 10 by bolts 39, as shown in FIGS. 2 and 3. When the lugs reach bottom 42*a* of the vertical slots, they are then moved laterally into horizontal grooves 44 in housing ring 37. The lugs are held in the horizontal grooves 42 by lock pin 46.

This is a very convenient and simple structural arrangement and method whereby the rotating spindle assembly of the rotating blowout preventer can be released from body 10 by simply removing lock pin 46, rotating the assembly until the lugs are in alignment with vertical slots 42, then the entire assembly can be raised with the kelly to make a connection on a trip. After the connection is made, the whole assembly is lowered back into body 10 with lugs 40 traveling through vertical slots 42, the rotating spindle assembly is then rotated to move lugs 40 into the horizontal grooves 44. The assembly is then locked in the body by inserting pin 46 into one of the vertical slots behind the lug in the horizontal slot to prevent the lugs from moving out of the horizontal slots until the pin is removed.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A rotating blowout preventer comprising:

a blowout preventer body for mounting on a blowout preventer stack, said blowout preventer body having a central, axial opening into which fluid from a well bore is received and a lateral flow line through which the fluid from the well bore can flow laterally out of the blowout preventer body, wherein an upper portion of an interior surface of the axial opening is provided with a substantially L-shaped slot;

a rotating spindle assembly selectively engageable with the blowout preventer body, the spindle assembling comprising:

a spindle housing a stripper rubber adapted to rotate with and provide a seal between the spindle assembly and a portion of pipe string extending through the spindle assembly to divert the fluid to the lateral flow line, and at least one lug mounted on the spindle housing and arranged to engage the substantially L-shaped slot.

2. The rotating blowout preventer of claim 1, wherein the substantially L-shaped slot defines an axial slot and a circumferential slot, the spindle assembly further comprising a locking bar selectively engageable with the axial slot for locking the lug in the circumferential slot.

3. The rotating blowout preventer of claim 1 further comprising a kelly bushing attached to the rotating spindle assembly.

4. A method of selectively engaging a rotating spindle assembly of a rotating blowout preventer to a blowout preventer body, comprising:

engaging at least one lug provided on a spindle housing with a substantially L-shaped slot provided on an upper interior surface of the blowout preventer body; and moving the lug in a substantially L-shaped motion in the substantially L-shaped slot to connect the rotating spindle assembly to the blowout preventer body.

5. The method of claim 4, further comprising:

moving the lug in a reverse of the substantially L-shaped motion in the substantially L-shaped slot; and disengaging the lug from the substantially L-shaped slot to release the rotating spindle assembly from the blowout preventer body.

6. The method of claim 4, further comprising inserting a locking bar into an axial portion of the substantially L-shaped slot to lock the lug in the L-shaped slot.

7. A rotating blowout preventer, comprising:

a blowout preventer body;

a substantially L-shaped slot provided on an upper portion of an interior surface of the blowout preventer body; and a rotating spindle assembly selectively engageable with the blowout preventer body, comprising:

a spindle housing; and at least one lug attached to the spindle housing and adapted to engage the substantially L-shaped slot.

8. The rotating blowout preventer of claim 7 wherein the substantially L-shaped slot defines an axial slot and a circumferential slot, further comprising a locking bar which is insertable into the axial slot of the substantially L-shaped slot.

* * * * *